US012678697B2

(12) United States Patent
Helmick, IV et al.

(10) Patent No.: US 12,678,697 B2
(45) Date of Patent: Jul. 14, 2026

(54) ROBOTIC ARM INTEGRATED IMMERSIVE REALITY

(71) Applicant: Universal City Studios LLC, Universal City, CA (US)

(72) Inventors: Nathaniel David Helmick, IV, Winter Park, FL (US); Bryan Zebleckes, Clermont, FL (US)

(73) Assignee: Universal City Studios LLC, Universal City, CA (US)

( * ) Notice: Subject to any disclaimer, the term of this patent is extended or adjusted under 35 U.S.C. 154(b) by 943 days.

(21) Appl. No.: 17/880,174

(22) Filed: Aug. 3, 2022

(65) Prior Publication Data

US 2023/0364523 A1 Nov. 16, 2023

Related U.S. Application Data

(60) Provisional application No. 63/340,279, filed on May 10, 2022.

(51) Int. Cl.
*A63G 31/02* (2006.01)

(52) U.S. Cl.
CPC ..... *A63G 31/02* (2013.01)

(58) Field of Classification Search
CPC ..... A63G 31/02
USPC ..... 472/59
See application file for complete search history.

(56) References Cited

U.S. PATENT DOCUMENTS

| | | | | |
|---|---|---|---|---|
| 5,716,281 | A * | 2/1998 | Dote | F41J 9/14 463/2 |
| 6,179,619 | B1 | 1/2001 | Tanaka | |
| 7,092,001 | B2 | 8/2006 | Schulz | |
| 8,641,540 | B2 * | 2/2014 | Feuer | A63G 7/00 472/43 |
| 9,298,254 | B2 | 3/2016 | Ha et al. | |
| 9,794,533 | B2 | 10/2017 | Flessas | |
| 9,812,045 | B2 * | 11/2017 | Choi | G03B 21/562 |
| 9,933,624 | B1 | 4/2018 | White et al. | |
| 11,029,759 | B2 | 6/2021 | Seo et al. | |
| 11,210,843 | B1 | 12/2021 | Coffey et al. | |
| 11,779,850 | B2 * | 10/2023 | Boyle | A63G 31/16 472/43 |
| 2010/0053029 | A1 | 3/2010 | Wilzbach et al. | |
| 2013/0145953 | A1 * | 6/2013 | Crawford | B61J 1/10 104/35 |

(Continued)

FOREIGN PATENT DOCUMENTS

WO WO-2011068566 A1 * 6/2011 ..... A63G 21/02

OTHER PUBLICATIONS

PCT/US2023/021391 Invitation to Pay Additional Fees mailed Aug. 30, 2023.

(Continued)

*Primary Examiner* — Joseph S Del Sole
(74) *Attorney, Agent, or Firm* — Fletcher Yoder, PC

(57) ABSTRACT

An attraction system includes a ride vehicle configured to move within the attraction system, a display coupled to the ride vehicle, and a control system communicatively coupled to the display. The control system is configured to determine a position and/or orientation of the display within the attraction system and operate the display to present an image based on the position and/or orientation of the display.

20 Claims, 8 Drawing Sheets

(56) References Cited

U.S. PATENT DOCUMENTS

| | | | | |
|---|---|---|---|---|
| 2016/0048203 | A1* | 2/2016 | Blum | G06F 3/012 104/84 |
| 2016/0115700 | A1* | 4/2016 | Jennings | E04H 3/30 52/10 |
| 2016/0346704 | A1 | 12/2016 | Wagner | |
| 2017/0364145 | A1 | 12/2017 | Blum et al. | |
| 2018/0255285 | A1* | 9/2018 | Hall | A63F 13/213 |
| 2019/0227328 | A1* | 7/2019 | Coatney | G02B 27/0176 |
| 2021/0279893 | A1* | 9/2021 | Iwanowski | G06T 7/248 |
| 2022/0083132 | A1* | 3/2022 | Hare | A63G 31/16 |
| 2022/0174451 | A1* | 6/2022 | Lugo | H04W 4/021 |
| 2023/0226458 | A1* | 7/2023 | Haynes | A63G 33/00 472/131 |
| 2023/0311011 | A1* | 10/2023 | Zebleckes | A63G 31/16 472/59 |
| 2024/0075394 | A1* | 3/2024 | Carbonar | A63G 7/00 |

OTHER PUBLICATIONS

Brennan, Dominic, "Holovis Uses Giant Robot Arms for Intense VR Motion Simulated Experiences," Road to VR, Jul. 15, 2017, 3 pages, https://www.roadtovr.com/holovis-uses-giant-robot-arms-intense-vr-motion-simulated-experiences/.

* cited by examiner

ROBOTIC ARM INTEGRATED IMMERSIVE REALITY

CROSS-REFERENCE TO RELATED APPLICATION

This application claims priority to and the benefit of U.S. Provisional Application No. 63/340,279, entitled "ROBOTIC ARM INTEGRATED IMMERSIVE REALITY," filed May 10, 2022, which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Throughout amusement parks and other entertainment venues, special effects can be used to help immerse guests in the experience of a ride or attraction. Immersive environments may include physical props and set pieces, robotic or mechanical elements, and/or display surfaces that present media. In addition, the immersive environment may include audio effects, smoke effects, and/or motion effects. Thus, immersive environments may include a combination of dynamic and static elements. With the increasing sophistication and complexity of modem ride attractions and the corresponding increase in expectations among theme or amusement park patrons, improved and more creative attractions are desirable, including ride attractions having more complex, immersive, and/or realistic special effects, such as visual effects.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an attraction system includes a ride vehicle configured to move within the attraction system, a display coupled to the ride vehicle, and a control system communicatively coupled to the display. The control system is configured to determine a position and/or orientation of the display within the attraction system and operate the display to present an image based on the position and/or orientation of the display.

In an embodiment, a non-transitory computer-readable medium includes instructions that, when executed by processing circuitry, cause the processing circuitry to instruct an actuator of an attraction system to move a display coupled to the actuator, determine a positioning of the display, determine image data based on the positioning of the display, and instruct the display to present an image based on the image data.

In an embodiment, an attraction system includes a display coupled to an actuator, a ride vehicle configured to move and cause movement of the display, and a control system communicatively coupled to the display. The control system is configured to instruct the actuator to move the display, determine a position and/or orientation of the display within the attraction system, and operate the display to present an image based on the position and/or orientation of the display.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
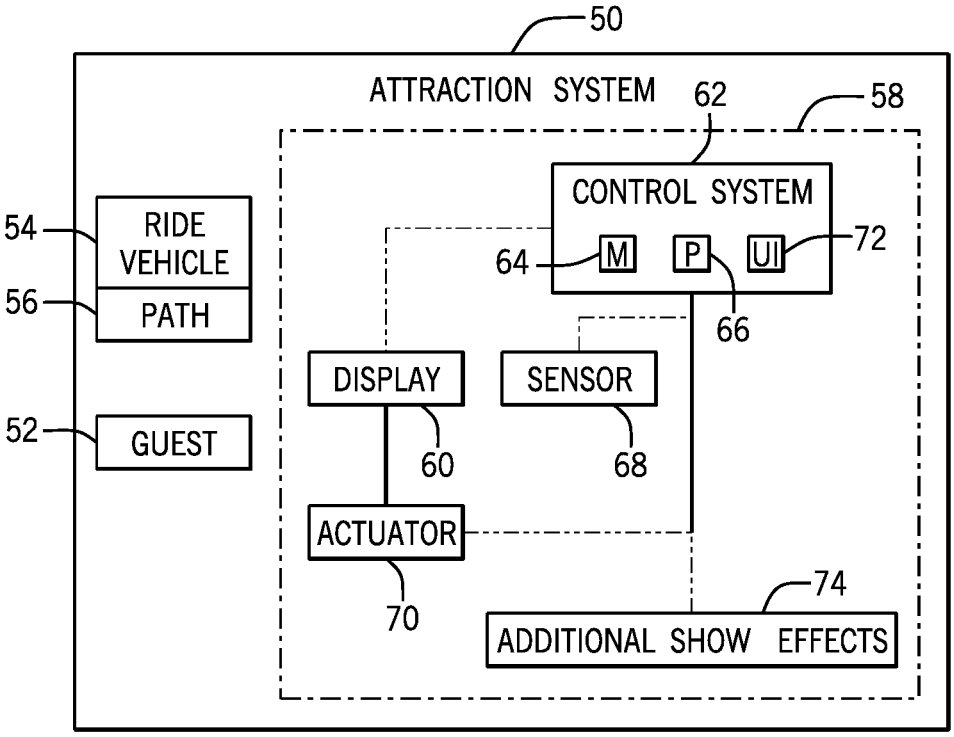
FIG. 1 is a schematic diagram of an embodiment of an attraction system that includes a display, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to an attraction system of an amusement or theme park. The amusement park may include a variety of features, such as rides (e.g., a roller coaster), theatrical shows, set designs, performers, and/or decoration elements, to entertain guests. Show effects may be used to supplement or complement the features, such as to provide the guests with a more immersive and/or unique experience. For example, the show effects may be presented to emulate real world elements in order to present a more realistic atmosphere for the guests.

In an embodiment, the show effect may include a display configured to present an output, such as an image and/or a video (e.g., a series of images), to the guests. For example, the output (e.g., imagery) of the display may include a visualization of a virtual environment (e.g., a virtual space defining a three-dimensional (3-D) model). During operation of the attraction system, the display may be positioned to enable the guests to view the output. For instance, the display may be moved to enable improved visibility of the display based on a position of the guests, and/or the display may be coupled to a ride vehicle of the attraction system, and movement of the ride vehicle may drive corresponding movement of the display. The movement of the display and the output of the display may cooperatively entertain the guests.

It may be desirable to adjust the output provided by the display in a manner that enhances portrayal of the virtual environment to the guests. As an example, as the display moves within the attraction system, it may be desirable to operate the display to present an output that portrays corresponding movement of the display in a virtual environment. Thus, the virtual environment (e.g., a perception of movement through the virtual environment) may be portrayed more realistically. Accordingly, embodiments of the present disclosure are directed to determining a positioning (e.g., a position, an orientation, a location) of the display and instructing the display to present an output based on the determined positioning. Thus, as the display moves, the display may be instructed to present an updated output. By way of example, the updated output may portray movement within a virtual environment corresponding to movement of the display. In an embodiment, respective outputs (e.g., image data that causes the display to present imagery) may be associated with a corresponding positioning of the display. Thus, based on a determined positioning of the display, an associated output may be selected for presentation via the display. In this manner, the output of the display may be more closely associated with movement of the display, and such operation of the display may provide benefits that are not easily achieved via existing techniques of operating a display (e.g., using a predetermined media file). As an example, the output may more realistically portray movement within the virtual environment based on movement of the display in the attraction system to provide a more realistic experience to the guests. As another example, the output of the display may be more unique or personalized, such as for an embodiment in which the movement of the display may be different or customizable for different ride cycles (e.g., based on a user input). Thus, operating the display based on a determined positioning of the display may improve operation of the attraction system to entertain the guests.

With the preceding in mind, FIG. 1 is a schematic diagram of an embodiment of an attraction system 50. The attraction system 50 may be configured to entertain one or more guests 52. In an embodiment, the attraction system 50 may include a ride vehicle 54 in which a guest 52 may be positioned. During operation of the attraction system 50, the ride vehicle 54 may move to provide movement sensations (e.g., a gravitational force, an inertial force, a postural adjustment) and/or carry the guest 52 to different parts of the attraction system 50. For example, the ride vehicle 54 may travel (e.g., translate) along a path 56, which may include a track, an open pathway, or any suitable route that the ride vehicle 54 may navigate. Additionally, or alternatively, the ride vehicle 54 may remain at a particular location within the attraction system 50 and may, for instance, move (e.g., pivot, rotate) about a base to change orientations at the location in order to move the guest 52 within the attraction system 50. The movement of the ride vehicle 54 may entertain the guest 52. Moreover, the guest 52 may navigate through and/or within the attraction system 50 without the ride vehicle 54. As an example, the attraction system 50 may include another path (e.g., a queue, an open pathway, a walkway) that the guest 52 may move along, and the attraction system 50 may include various features to entertain the guest 52 moving through and/or within the attraction system 50.

The attraction system 50 may also include a show effect system 58 configured to provide further entertainment to the guest 52. In an embodiment, the show effect system 58 may include a display 60 configured to provide an output (e.g., a media output, a virtual output) viewable to the guest 52. The output may include imagery, such as an image or a video (e.g., a plurality of images that is sequentially presented). For example, the output provided by the display 60 may present a virtual environment in which the guest 52 may be immersed. The output may be based on the movement of the display 60 within the attraction system 50 to portray movement of the display 60 in the virtual environment, thereby providing a more realistic appearance of the virtual environment.

To this end, the attraction system 50 (e.g., the show effect system 58) may include a control system 62 (e.g., an automation controller, a programmable controller, an electronic controller) communicatively coupled to the display 60 and configured to operate the display 60. The control system 62 may include a memory 64 and processing circuitry 66. The memory 64 may include volatile memory, such as random access memory (RAM), and/or non-volatile memory, such as read-only memory (ROM), optical drives, hard disc drives, solid-state drives, or any other non-transitory computer-readable medium that includes instructions. The processing circuitry 66 may be configured to execute such instructions. For example, the processing circuitry 66 may include one or more application specific integrated circuits (ASICs), one or more field programmable gate arrays (FPGAs), one or more general purpose processors, or any combination thereof.

The control system 62 may be configured to operate the display 60 to provide an output based on a positioning, such as position and/or an orientation, of the display 60. To this end, the show effect system 50 may include a sensor 68 configured to monitor a parameter associated with the positioning of the display 60. The sensor 68 may transmit data indicative of the parameter to the control system 62, and the control system 62 may operate the display 60 based on the parameter. In an embodiment, the sensor 68 may include a position sensor, which may include an optical sensor (e.g., a camera), a remote sensing device (e.g., a light detection and ranging sensor), a proximity sensor, another suitable position sensor, or any combination thereof. In such an embodiment, the parameter monitored by the sensor 68 may directly correspond to a positioning of the display 60 determined by the sensor 68. In an additional or alternative embodiment, the sensor 68 may include a movement or motion sensor, which may include an accelerometer, a gyroscope, an inertial measurement unit, another movement sensor, or any combination thereof. In such an embodiment, the parameter monitored by the sensor 68 may include movement or an adjustment of the positioning of the display 60. The control system 62 may determine a change in positioning of the display 60 based on movement data received from the sensor 68. For example, the control system 62 may determine an updated positioning of the display 60 based on a determined movement of the display 60 from a previous positioning of the display 60.

The control system 62 may, for example, determine a position and/or orientation of the display 60 within a virtual 3-D coordinate system based on the data received from the sensor 68 indicating the positioning of the display 60 in the real world. The control system 62 may then operate the display 60 based on the position and/or orientation of the display 60 within the 3-D coordinate system. By way of example, the control system 62 may refer to information or data that associates or maps different image data to respective positionings (e.g., a position, an orientation, a coordinate, a location) of the display 60 within the 3-D coordinate system. In response to determining the positioning of the display 60 within the 3-D coordinate system, the control system 62 may select the image data associated with the positioning of the display 60 based on the referenced information, and the control system 62 may instruct the display 60 to present an image based on the selected image data. As an example, the control system 62 may transmit the image data to the display 60 to cause the display 60 to present an image corresponding to the image data. For instance, each image data associated with the various positionings of the display 60 within the 3-D coordinate system may correspond to an appearance of a virtual environment viewed from the positioning within the 3-D coordinate system. Based on a change in positioning of the display 60 within the 3-D coordinate system (e.g., caused by movement of the display 60 in the real world), the control system 62 may determine updated image data associated with an updated appearance of the virtual environment (e.g., viewed from the positioning within the 3-D coordinate system). The control system 62 may transmit the updated image data to the display 60 to cause the display 60 to present an image providing the updated appearance of the virtual environment, such as to portray movement of the display 60 within the virtual environment corresponding to physical movement of the display 60 in the real world.

In an embodiment, an actuator 70 of the show effect system 58 (e.g., of the attraction system 50) may be configured to move the display 60. As an example, the actuator 70 may include a robotic arm with segments that are movable relative to one another, and operation of the actuator 70 may move the segments to drive movement of the display 60. As another example, the actuator 70 may include a combination of winches, pulleys, and/or cables or ropes coupled to the display 60, and operation of the actuator 70 may cause the winches and pulleys to move (e.g., pull, extend) the cables or ropes to move the display 60. As a further example, the actuator 70 may include a platform assembly (e.g., a parallel manipulator) having multiple platforms configured to move relative to one another. The display 60 may be coupled to one of the platforms, and operation of the actuator 70 to drive movement of the platforms may cause movement of the display 60. The actuator 70 may additionally or alternatively include any suitable component or device configured to drive the display 60 to move.

The control system 62 may be communicatively coupled to the actuator 70 and may be configured to instruct the actuator 70 to move the display 60. In one embodiment, the control system 62 may be configured to instruct the actuator 70 to move the display 60 in a pre-programmed, preset, or predetermined path or manner, such as based on a particular ride cycle (e.g., in which the ride vehicle 54 travels along the path 56) and/or based on a time of operation of the attraction system 50. In an additional or alternative embodiment, the control system 62 may be configured to instruct the actuator 70 to move based on input data. As an example, the control system 62 may receive data (e.g., from the sensor 68) indicative of a position of the guest 52 in the attraction system 50. For instance, the guest 52 may navigate the attraction system 50 and/or move via movement of the ride vehicle 54 carrying the guest 52 along the path 56. The control system 62 may instruct the actuator 70 to move based on the determined position of the guest 52, such as to position the display 60 relative to the guest 52 to enable the guest 52 to view the output of the display 60. As another example, the control system 62 may receive a user input and operate the actuator 70 based on the user input. Therefore, the control system 62 may include or be communicatively coupled to a user interface 72, such as a touch screen, a trackpad, a mouse, a button, a switch, a dial, a slider, a lever, and the like. The guest 52 may interact with the user interface 72 to transmit the user input, and the control system 62 may receive the user input and instruct the actuator 70 to move the display 60 based on the user input. For instance, the user input may be indicative of a request to move the display 60 in a particular direction and/or to a target position, and the control system 62 may be configured to instruct the display 60 to move in the particular direction and/or to the target position in response.

In an embodiment, the control system 62 may include a single controller configured to determine the positioning of the display 60 (e.g., via the sensor 68), operate the display 60 to present content, and instruct the actuator 70 to move the display 60. In an additional or alternative embodiment, the control system 62 may include one or more separate controllers (e.g., a primary controller, a secondary controller) configured to coordinate to operate the display 60, the actuator 70, and/or any other feature of the attraction system 50. By way of example, a first controller of the control system 62 may determine the positioning of the display 60, a second controller of the control system 62 may operate the display 60 (e.g., based on communication with the first controller), and a third controller of the control system 62 may instruct the actuator 70 to move the display 60 (e.g., based on communication with the first controller and/or the second controller). Indeed, the control system 62 may include any suitable number of controllers to operate one or more subsystems (e.g., the display 60, the actuator 70, the ride vehicle 54) of the attraction system 50.

In an embodiment, the actuator 70 may be attached to, secured to, mounted to, or engaged with the ride vehicle 54. By way of example, the display 60 may be coupled to the ride vehicle 54, and the actuator 70 may be coupled to and configured to drive movement of the ride vehicle 54. Thus, operation of the actuator 70 may move the ride vehicle 54 and drive corresponding movement of the display 60 coupled to the ride vehicle 54. Additionally, or alternatively, the actuator 70 may be coupled to the ride vehicle 54, and the display 60 may be coupled to the actuator 70. Thus, movement of the ride vehicle 54 (e.g., along the path 56) may drive movement of the actuator 70 and the display 60. The control system 62 may also operate the actuator 70 to cause additional movement of the display 60. In an additional or alternative embodiment, the actuator 70 may be separate from the ride vehicle 54. For example, the actuator 70 may be coupled to a base that is not a part of the ride vehicle 54, and the actuator 70 may therefore move separately from the ride vehicle 54. In other words, movement of the ride vehicle 54 may not directly drive movement of the actuator 70 and the display 60.

In any case, based on the movement of the display 60, as caused by movement of the ride vehicle 54 and/or movement of the actuator 70, the control system 62 may instruct the display 60 to present a particular output. Operating the display 60 to present a location-based output may improve the experience provided to the guest 52. For instance, operation of the display 60 may be more flexible as compared to outputting a preprogrammed or predetermined media file. As an example, the control system 62 may be configured to cause the display 60 to present a different output (e.g., based on different movement of the display 60) for different ride cycles, thereby providing a more unique or personalized experience to the guest 52. As another example, the output provided by the display 60 may correspond to the movement and/or determined positioning of the display 60 more appropriately as compared to a preprogrammed media file. That is, the output may be more synchronized with or may match the movement of the display 60 more closely. For instance, different ride cycles may have varying movements and/or motions (e.g., speeds, acceleration, vibration) of the display 60, such as based on a condition of the actuator 70, a weight or number of the guests 52 in the ride vehicle 54 driving motion of the display 60, a wind speed, and so forth. However, a preprogrammed media file, such as a preset video, may not be altered for different ride cycles. Thus, the preprogrammed media file may not match the different movements and/or motions associated with certain ride cycles.

However, an output provided by the display 60 based on the position and/or orientation of the display 60 may accommodate the variation in movements and/or motions for different ride cycles. For instance, the display 60 may present a realistic appearance of movement through a virtual environment in correspondence with movement of the display 60. This may be achieved by using a 3-D model, which may include an application that uses mathematical modeling to depict a 3-D environment as a virtual space and map the 3-D environment to the 3-D coordinate system to account for all or a subset of views into the virtual space that can be achieved within a display envelope (e.g., boundaries of the positioning of the display 60) in the 3-D coordinate system. In other words, coordination between the 3-D model and the display 60 or multiple displays may be used to depict views into the virtual space from available perspectives (e.g., viewpoints of riders in the ride vehicle 54 driving motion of the display 60) with the display envelope. Thus, presented content (e.g., images) caused by changes, including minor, small, or incremental changes, in positioning of the display 60 in the physical world are accounted for by the 3-D model based on corresponding changes in positioning of the display 60 in the 3-D coordinate system without requiring a special media track for differing paths and/or without creating discontinuity between movements of the display 60 and content presented via the display 60. For example, based on a positioning of the display 60 in the 3-D coordinate system, content depicting a view into the virtual space associated with the 3-D environment may be selected.

In some embodiments, a change in positioning of the display 60 in the real world may not directly correspond to the same change in positioning of the display 60 with respect to the 3-D coordinate system. For instance, a certain movement of the display 60 in the real world may be amplified or muted in the 3-D coordinate system. As an example, movement of the display 60 along a vertical distance in the real world may cause movement of the display 60 along an increased vertical distance in the 3-D coordinate system. As another example, rotation of the display 60 at a certain angle in the real world may cause rotation of the display 60 at a reduced angle in the 3-D coordinate system. Such discrepancies between the change in positioning of the display 60 in the real world and the change in positioning of the display 60 in the 3-D coordinate system may cause certain content associated with the 3-D environment to be selected and presented to provide a more desirable experience to the guests. For example, the presented content may depict movement of the display 60 at a high speed in the 3-D environment to provide an appearance that the guest is traveling at a higher speed in the real world than that actually effectuated by the ride vehicle 54.

Moreover, operating the display 60 to provide an output based on positioning instead of using a preprogrammed media file may facilitate ease of adjusting operation of the attraction system 50. By way of example, it may be desirable to adjust the movement of the display 60, such as by adjusting movement of the ride vehicle 54 (e.g., by changing operation of the actuator 70, by changing a feature of the path 56), in order to change the entertainment provided to the guests 52. Instead of having to prepare an updated preprogrammed media file, such as by creating an initial preprogrammed media file, testing the output of the initially created preprogrammed media file in conjunction with movement of the display 60, and adjusting the initially created preprogrammed media profile based on testing, an updated output of the display 60 may be readily available for presentation. That is, the movement of the display 60 may include updated positioning of the display 60 (e.g., within the 3-D coordinate system), and image data may already be mapped to the updated positioning (e.g., as part of a comprehensive digital 3-D model including the 3-D environment mapped to the 3-D coordinate system). Thus, the image data may be readily generated or selected based on the 3-D model, such as the positioning of the display 60 within the 3-D coordinate system and a correlation between the positioning of the display 60 within the 3-D coordinate system (e.g., as caused by the position and/or orientation of the display 60 within the attraction system 50) and the 3-D environment while the display 60 is being moved.

Furthermore, the display 60 may be separate from the guest 52. That is, the display 60 may not be directly in contact with or equipped by the guest 52, such as via a device or component (e.g., a headset) that may significantly limit a field of view of the guest 52. Thus, movement of the display 60 may be separate from movement of the guest 52. For example, multiple guests 52 may be able to view a single display 60. Therefore, a single display 60 may provide immersive entertainment to several guests 52 to increase efficient operation of the attraction system 50. In addition, the output provided by the display 60 may be more suitable or be of better quality for various guests 52 as compared to a wearable device that provides an output (e.g., a headset that provides an output directly in front of a user) that may vary in quality for different guests 52 (e.g., guests 52 having different pupil distances to affect a quality of the output provided in front of them). Moreover, the display 60 may be positioned to enable the guest 52 to view other features of the attraction system 50. For instance, the control system 62 may cause the actuator 70 to position the display 60 at a particular offset distance from the guest 52 to avoid blocking a field of view of the guest 52, thereby enabling the guest 52 to see additional show effects 74 of the show effect system 58. By way of example, the additional show effects 74 may include an animated figure, a decoration, a smoke effect, a fog effect, lighting, another output (e.g., other imagery provided by another display), or any other suitable show effect that the control system 62 may operate to further enhance the experience provided to the guest 52. Indeed, the guest 52 may be able to view the virtual elements provided by the display 60 in addition to real world elements of the attraction system 50.

Further still, since the guest 52 may not be in direct contact with the display 60, a desirable structure or integrity of the display 60 may be maintained. As an example, wear or deterioration of the display 60 (e.g., that would otherwise be caused by contact or interaction between the guest 52 and the display 60) may be reduced to increase a useful lifespan of the display 60, thereby reducing maintenance operations to repair or replace the display 60. As another example, a cleaner appearance or structure of the display 60 may be maintained. Thus, fewer operations may be performed with respect to the display 60, thereby further improving an efficiency and/or reducing a cost associated with operation of the attraction system 50. Indeed, the display 60 described herein may improve a performance of the attraction system 50 to entertain the guest 52 in an efficient manner.

In one embodiment, the display 60 may also be used to improve performance of maintenance and/or service operations of the attraction system 50. By way of example, a user (e.g., an operator, a technician) may more easily navigate through and/or within the attraction system 50 (e.g., without having to equip an additional component that displays imagery) to inspect whether movement of the display 60 and/or the output provided by the display 60 are desirable. In addition, the user may be able to more easily inspect other components or features of the attraction system 50 (e.g., the ride vehicle 54, the additional show effects 74) that are separate from the display 60, such as in conjunction with inspection of the display 60. As such, the maintenance and/or service operations may be more efficiently performed.

Figure 2:
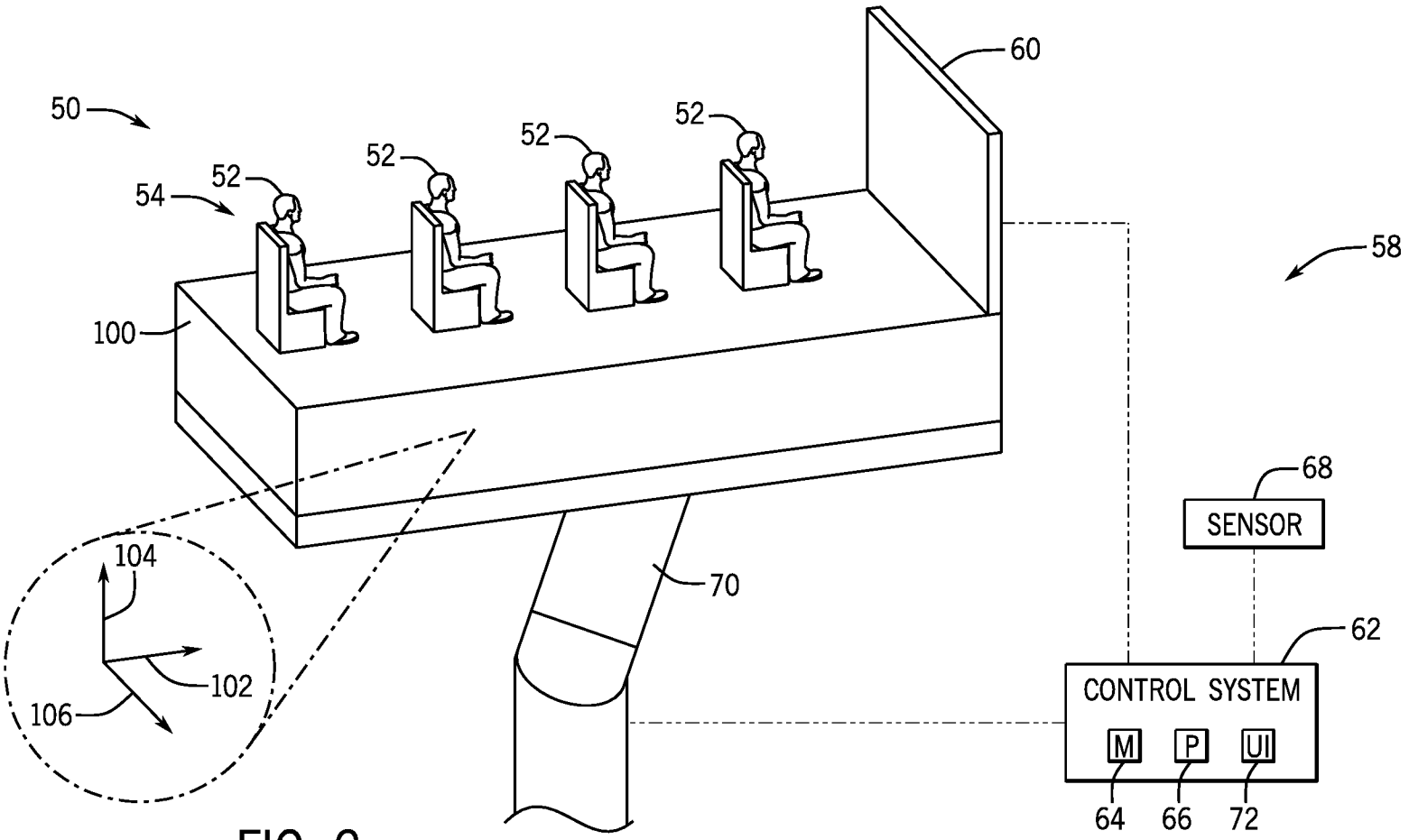
FIG. 2 is a perspective view of an embodiment of an attraction system that includes a display coupled to a ride vehicle, in accordance with an aspect of the present disclosure.

FIG. 2 is a perspective view of an embodiment of the attraction system 50 that includes the ride vehicle 54. Guests 52 may be positioned within a chassis 100 of the ride vehicle 54, and the actuator 70, shown as a robotic arm in the illustrated embodiment, may be coupled to the chassis 100. Operation of the actuator 70 may drive movement of the ride vehicle 54 to move and entertain the guests 52. As an example, the control system 62 may be configured to instruct the actuator 70 to move the ride vehicle 54 during operation of the attraction system 50. For instance, the actuator 70 may be configured to translate the ride vehicle 54 along a first axis 102 (e.g., a longitudinal axis), along a second axis 104 (e.g., a vertical axis), along a third axis 106 (e.g., a lateral axis), and/or along any other suitable axis (e.g., an axis between the first axis 102, the second axis 104, and the third axis 106). Additionally, or alternatively, the actuator 70 may be configured to rotate the ride vehicle 54 about the first axis 102, about the second axis 104, about the third axis 106, or about any other suitable axis. Although the illustrated actuator 70 includes a robotic arm, the actuator 70 may include any suitable component, device, system, or assembly in an additional or alternative embodiment. The control system 62 may be configured to instruct the actuator 70 to move the ride vehicle 54 based on any suitable parameter, such as in a predetermined motion or route for a ride cycle, based on sensor data (e.g., received from the sensor 68), and/or based on a user input (e.g., received via the user interface 72).

The display 60 may be coupled to (e.g., directly coupled to, mounted to, secured to, attached to, engaged with) the chassis 100 at a position in which multiple guests 52 positioned within the chassis 100 may see the output provided by the display 60. In this manner, the display 60 may be coupled to (e.g., indirectly coupled to) the actuator 70 via the ride vehicle 54. The coupling between the display 60 and the chassis 100 may enable movement of the ride vehicle 54 to drive corresponding movement of the display 60. For instance, the display 60 may be fixedly coupled to the chassis 100 such that relative movement between the ride vehicle 54 and the display 60 may be blocked, thereby enabling the guests 52 to view the output provided by the display 60 regardless of the position and/or orientation of the ride vehicle 54. The control system 62 may be configured to operate the display 60 to provide an output based on a position of the display 60. By way of example, the display 60 may be at a first position and/or a first orientation, and the control system 62 may be configured to instruct the display 60 to present imagery based on the first position and/or the first orientation. During operation of the attraction system 50, the ride vehicle 54 may move (e.g., via the actuator 70) to transition the display 60 to a second position and/or a second orientation, and the control system 62 may be configured to instruct the display 60 to present updated imagery based on the second position and/or the second orientation.

In an example embodiment, the sensor 68 may monitor the position and/or orientation of the display 60 (e.g., within the attraction system 50), and the control system 62 may determine the position and/or orientation of the display 60 based on data received from the sensor 68. In an additional or alternative embodiment, the control system 62 may determine the position and/or orientation of the display 60 based on operation of the actuator 70, such as an instructed positioning and/or movement of the actuator 70. In either embodiment, the control system 62 may operate the display 60 to present an output based on the determined position and/or orientation of the display 60 (e.g., based on image data mapped to the position and/or orientation of the display 60).

In an embodiment, the updated imagery may portray movement of the ride vehicle 54 through a virtual environment to correspond with movement of the ride vehicle 54 in the real world, as caused by the actuator 70. As an example, based on a determination that the ride vehicle 54 moves in a forward direction (e.g., along the first axis 102), the control system 62 may cause the display 60 to present imagery that portrays forward movement in the virtual environment (e.g., by updating a position of various virtual elements in the imagery provided by the display 60). As another example, based on a determination that the ride vehicle 54 rotates (e.g., about the third axis 106) to cause the guests 52 to face more upwardly, the control system 62 may cause the display 60 to present imagery that portrays a more upward view of the virtual environment. As such, a more realistic portrayal of the virtual environment in coordination with the movement of the ride vehicle 54 may be achieved via the operation of the display 60.

Figure 3:
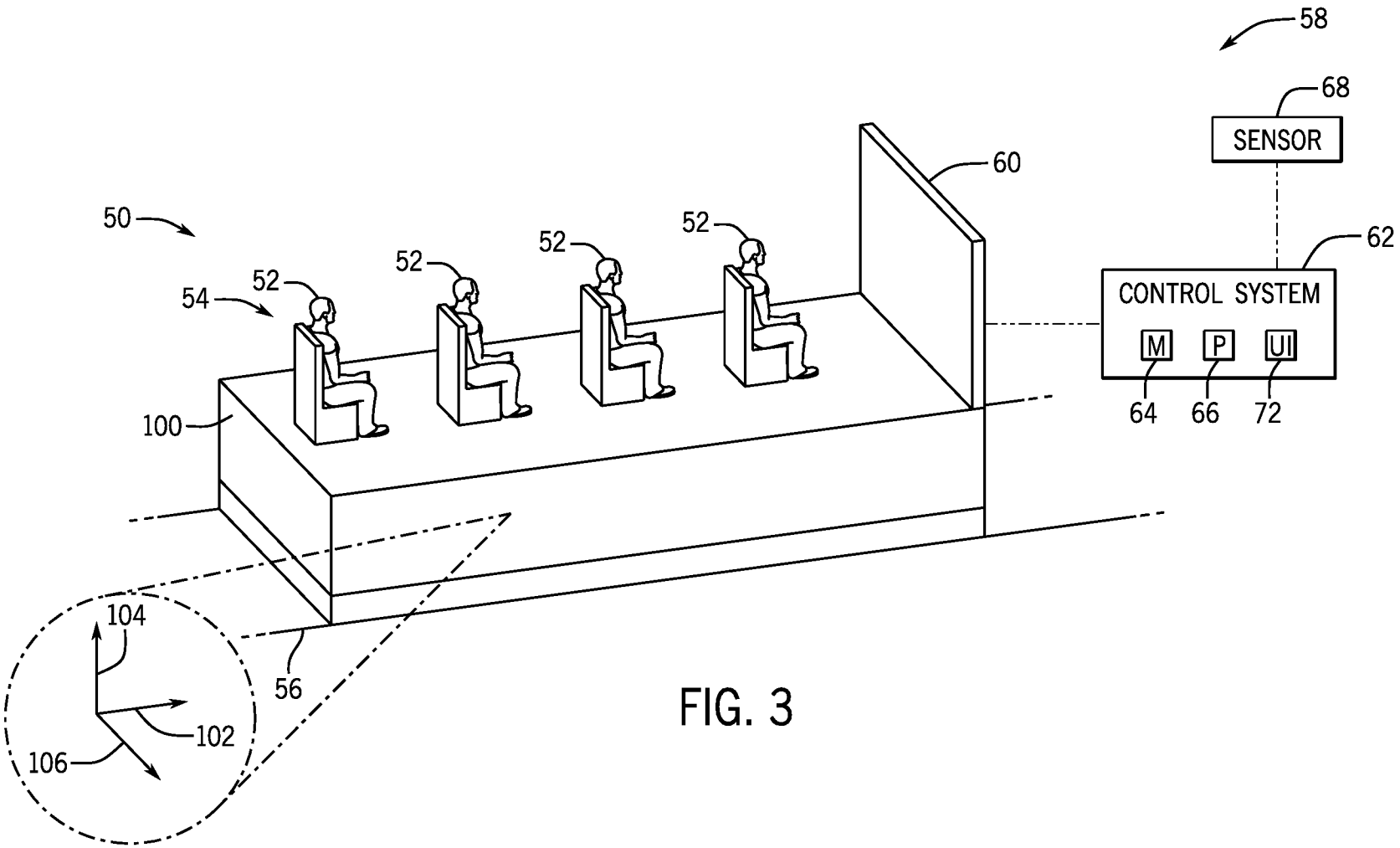
FIG. 3 is a perspective view of an embodiment of an attraction system that includes a display coupled to a ride vehicle, in accordance with an aspect of the present disclosure.

FIG. 3 is a perspective view of an embodiment of the attraction system 50 that includes the ride vehicle 54. In the illustrated embodiment, the display 60 is coupled to (e.g., directly coupled to, fixedly coupled to) the chassis 100 of the ride vehicle 54, and the ride vehicle 54 is configured to move along a path 56. By way of example, the path 56 may include various features, such as a hill, a drop, a turn, a curve, an inversion, and so forth, that may adjust the position and/or orientation of the ride vehicle 54 (e.g., about the axes 102, 104, 106) during movement along the path 56. Such movement of the ride vehicle 54 may also drive corresponding movement of the display 60. As such, during movement of the ride vehicle 54 along the path 56, the control system 62 may be configured to operate the display 60 to update the output presented by the display 60 to the guests 52. For example, the control system 62 may receive data from the sensor 68 indicating the position and/or orientation of the display 60, and the control system 62 may operate the display 60 to present an output based on the position and/or orientation of the display 60.

Although the display 60 is positioned in front of the guests 52 in the embodiments illustrated in FIGS. 2 and 3, the display 60 may be arranged in a different position with respect to the guests 52, such as behind the guests 52 and/or at a lateral side (e.g., a right side, a left side) of the chassis 100, in an additional or alternative embodiment. For example, the display 60 may be positioned to enable the guests 52 to see a path of travel in front of the ride vehicle 54. The control system 62 may operate the display 60 based on a position and/or orientation of the display 60 to enhance the experience provided to the guests 52. By way of example, in an embodiment in which the display 60 is positioned laterally with respect to the guests 52, the control system 62 may operate the display 60 to portray movement of the ride vehicle 54 along various virtual elements to cause the guests 52 to perceive movement of the ride vehicle 54 within a virtual environment in correspondence with movement of the ride vehicle 54 in the real world.

In either embodiment shown in FIGS. 2 and 3, although the display 60 may be coupled to the chassis 100 at a position to enable the guest 52 to view the output provided by the display 60, the guest 52 may also be able to view other features and aspects of the attraction system 50. That is, the display 60 may be positioned to avoid blocking a field of view from the ride vehicle 54 to other locations within the attraction system 50. For example, other show effects (e.g., the additional show effects 74), such as lighting, smoke effects, fog effects, and so forth, may be provided, and such show effects may supplement the output (e.g., imagery) provided by the display 60. Thus, the display 60 may be one of many show effects provided by the attraction system 50 and experienced by the guests 52.

Figure 4:
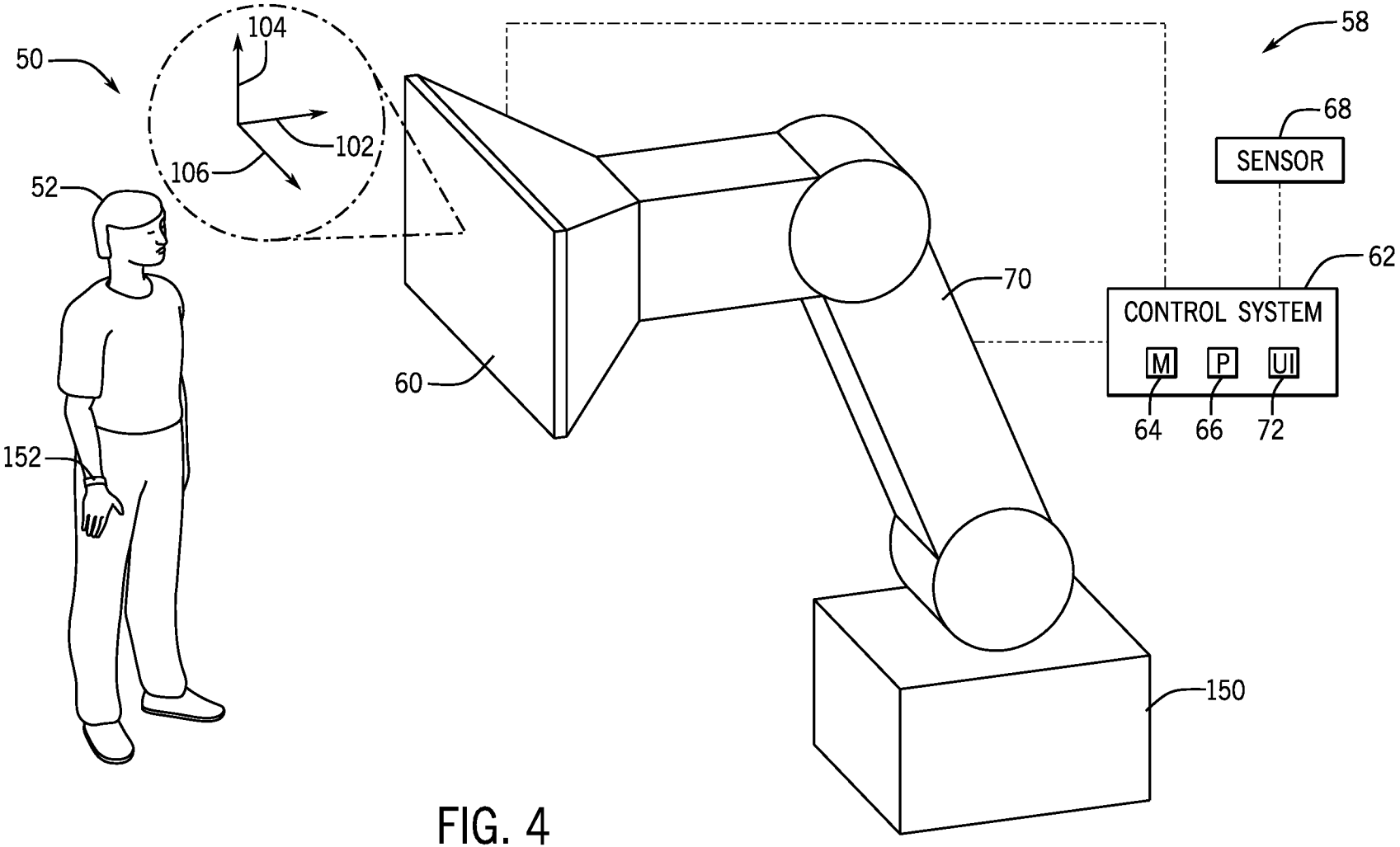
FIG. 4 is a perspective view of an embodiment of an attraction system that includes a display coupled to an actuator, in accordance with an aspect of the present disclosure.

FIG. 4 is a perspective view of an embodiment of the attraction system 50. The display 60 may be configured to move relative to a guest 52 that is not in the ride vehicle 54, such as a guest 52 that is navigating (e.g., walking) through and/or within the attraction system 50. For example, the display 60 may be directly coupled to (e.g., secured to, engaged with, mounted to, attached to) the actuator 70, and the actuator 70 may be coupled to a base 150. The control system 62 may be configured to instruct the base 150 to move within the attraction system 50 and/or to instruct the actuator 70 to move (e.g., translate, rotate) the display 60 relative to the base 150. For instance, the control system 62 may instruct the actuator 70 and/or the base 150 to move the display 60 in any suitable direction with respect to the axes 102, 104, 106. In an additional or alternative embodiment, the actuator 70 may include any suitable mechanism or components configured to cause the display 60 to move within the attraction system 50.

In an embodiment, the control system 62 may be configured to position the display 60 relative to the guest 52 to enable the guest 52 to view the output presented by the display 60. For this reason, the control system 62 may be configured to determine a viewing perspective of the guest 52, such as based on a position of the guest 52, an orientation of the guest 52, a facial feature of the guest 52, and so forth. The control system 62 may be configured to instruct the actuator 70 to move based on the viewing perspective of the guest 52 to enable the guest 52 to see the output presented by the display 60 as the guest 52 moves within the attraction system 50. For instance, the control system 62 may instruct the actuator 70 to move the display 60 and maintain positioning of the display 60 in front of and/or adjacent to the guest 52.

In an embodiment, the sensor 68 may be configured to determine a parameter indicative of the viewing perspective of the guest 52. The control system 62 may be configured to instruct the actuator 70 to move based on data received from the sensor 68 indicating the viewing perspective of the guest 52. As an example, the sensor 68 may include a camera configured to capture an image of the guest 52, and the control system 62 may determine the viewing perspective of the guest 52 based on the image. As another example, the guest 52 may be in possession of and/or may equip a device 152 of the attraction system 50, such as a band, a strap, a headset, a mobile device, and the like. The sensor 68 may be configured to track the positioning of the device 152, and the control system 62 may determine a viewing perspective of the guest 52 based on data indicative of the positioning of the device 152.

The control system 62 may be configured to operate the display 60 to present an output based on the position and/or orientation of the display 60 (e.g., as arranged via the actuator 70). As an example, the control system 62 may be configured to cause the display 60 to present imagery of a virtual environment and, as the display 60 moves, the imagery presented by the display 60 may be adjusted to present different viewpoints of the virtual environment. For instance, the control system 62 may be configured to instruct the actuator 70 to move the display 60 to a first position based on a first viewing perspective of the guest 52 to enable the guest 52 to view the display 60, and the control system 62 may instruct the display 60 to present first imagery of a virtual environment based on the first position of the display 60. The guest 52 may move and have a second viewing perspective, and the control system 62 may be configured to instruct the actuator 70 to move the display 60 to a second position based on the second viewing perspective of the guest 52 to enable the guest 52 to view the display 60. The control system 62 may also instruct the display 60 to present second imagery of the virtual environment based on the second position of the guest 52, and the second imagery may include a different viewpoint of the virtual environment as that provided by the first imagery. That is, the second imagery may update the appearance of the virtual environment to portray that, due to movement of the guest 52 through and/or within the attraction system 50, the guest 52 is viewing the virtual environment from a different perspective. Thus, the guest 52 may perceive that movement through and/or within the attraction system 50 causes navigation through the virtual environment. Thus, the virtual environment may be more realistically presented to the guest 52.

Figure 5:
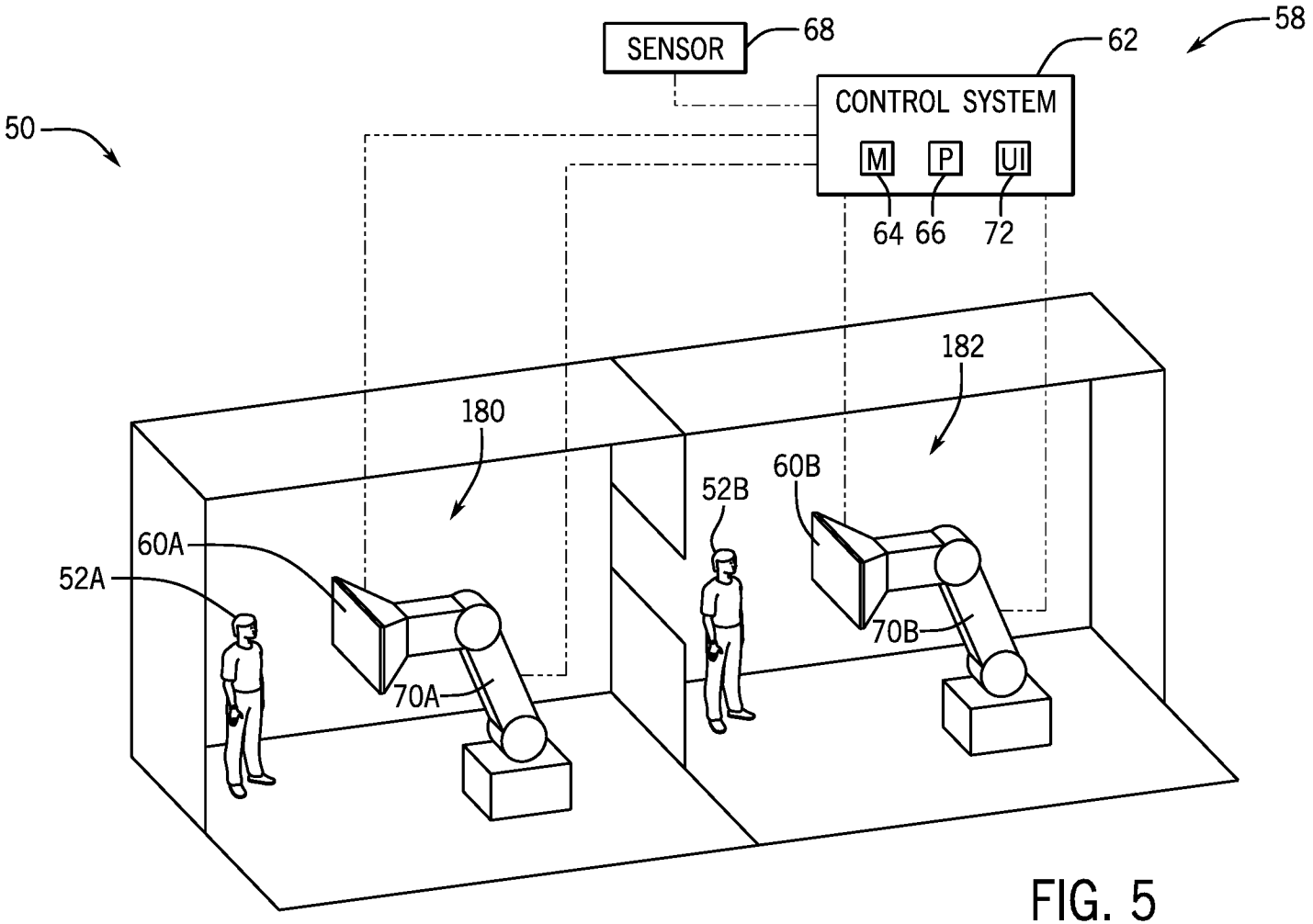
FIG. 5 is a perspective view of an embodiment of an attraction system that includes multiple displays coupled to respective actuators, in accordance with an aspect of the present disclosure.

FIG. 5 is a perspective view of an embodiment of the attraction system 50. The attraction system 50 may include multiple areas, such as rooms, levels, enclosed volumes, and the like. A first area 180 may include a first actuator 70A coupled to (e.g., directly coupled to) a first display 60A. A first guest 52A may be positioned in the first area 180 and may navigate through the first area 180. The control system 62 may determine a viewing perspective of the first guest 52A (e.g., via data received from the sensor 68) in the first area 180 and operate the first actuator 70A based on the viewing perspective, such as to move the first display 60A in front of and/or adjacent to the first guest 52A in the first area 180. The control system 62 may also operate the first display 60A to present an output based on movement of the first display 60A, such as based on a position and/or orientation of the first display 60A in the first area 180. Additionally, a second area 182 may include a second actuator 70B coupled to a second display 60B. A second guest 52B may be positioned in the second area 182 and may navigate through the second area 182. The control system 62 may determine a viewing perspective of the second guest 52B (e.g., via data received from the sensor 68), operate the second actuator 70B based on the viewing perspective in the second area 182, and operate the second display 60B to present an output based on movement of the second display 60B.

Indeed, the control system 62 may operate the first display 60A and the second display 60B independently from one another, as well as the first actuator 70A and the second actuator 70B independent from one another. For example, the control system 62 may operate the first actuator 70A and the first display 60A based on the viewing perspective of the first guest 52A in the first area 180 regardless of the viewing perspective of the second guest 52B in the second area 182, and the control system 62 may operate the second actuator 70B and the second display 60B based on the viewing perspective of the second guest 52B in the second area 182 regardless of the viewing perspective of the first guest 52A in the first area 180. Thus, the attraction system 50 may present a unique experience to each of the guests 52 in the separate areas 180, 182.

In an embodiment, a guest 52 may navigate through the areas 180, 182 in a sequential manner, such as from the first area 180 to the second area 182. The control system 62 may be configured to adjust control of the displays 60 and/or the actuators 70 based on the transition of the guest 52 between the first area 180 and the second area 182. By way of example, in response to determining that the first guest 52A is in the first area 180, the control system 62 may operate the first actuator 70A and/or the first display 60A to present an output to the first guest 52A based on movement of the first guest 52A within the first area 180. The first guest 52A may navigate from the first area 180 to the second area 182, and the control system 62 may then determine that the first guest 52A is in the second area 182 and not in the first area 180 (e.g., based on data received from the sensor 68). In response, the control system 62 may operate the second actuator 70B and/or the second display 60B, instead of the first actuator 70A and/or the first display 60A, to present an output to the first guest 52A based on movement of the first guest 52A within the second area 182. Thus, respective operation of the displays 60 and/or the actuators 70 may be associated with one of the areas 180, 182. For example, the output presented by the first display 60A may be associated with a first virtual environment (e.g., a first graphics-based representation based on a 3-D model), and the output presented by the second display 60B may be associated with a second virtual environment (e.g., a second graphics-based representation based on a 3-D model) that is different than the first virtual environment. Therefore, as the first guest 52A transitions between different areas 180, 182, the first guest 52A may view a different virtual environment via the displays 60. In this manner, the first guest 52A may perceive a transition between different virtual environments as a result of transitioning between the different areas 180, 182. As a result, a unique experience may be provided to the guests 52 as the guests 52 navigate between different areas 180, 182 within the attraction system 50.

Figure 6:
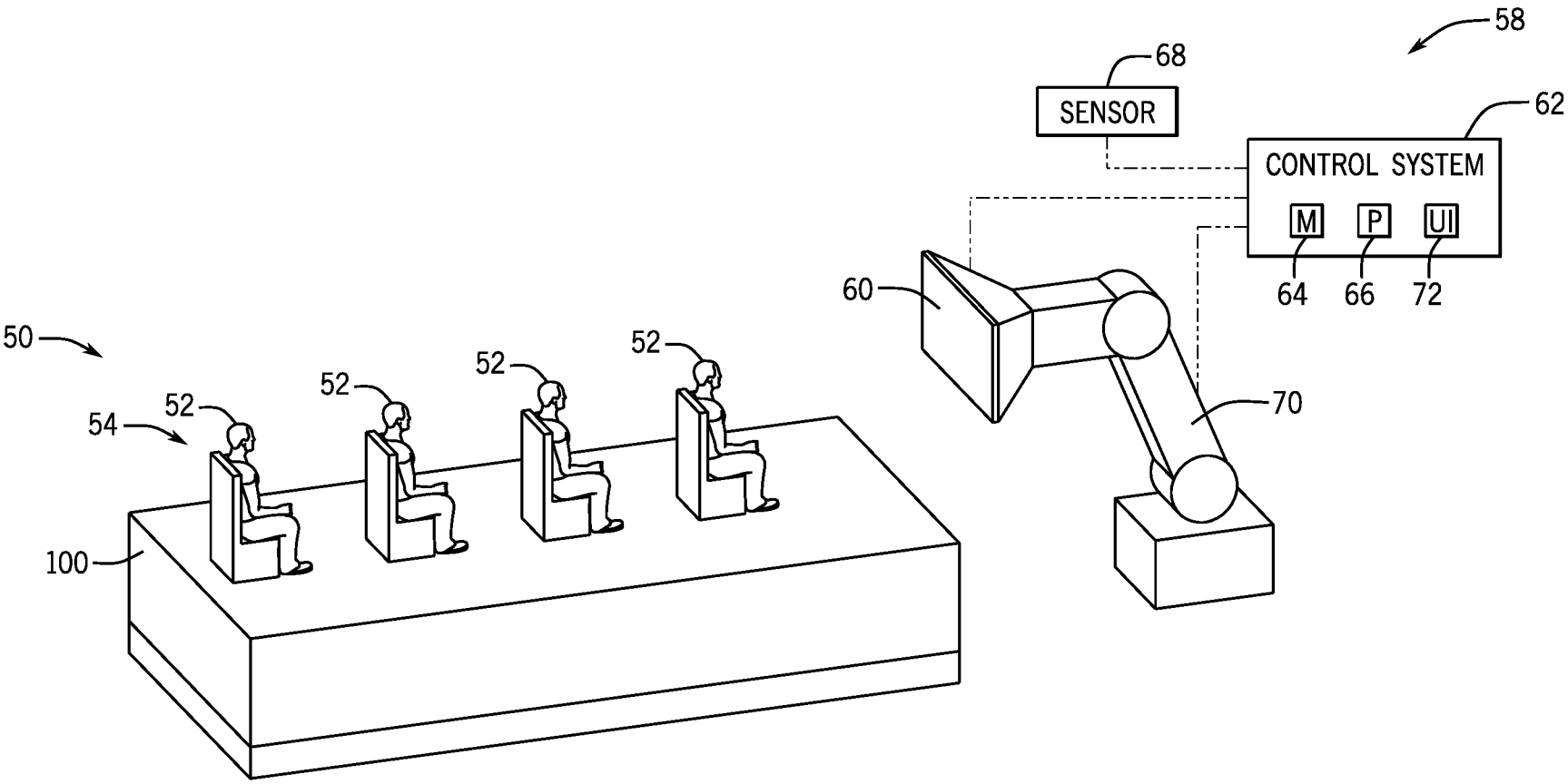
FIG. 6 is a perspective view of an embodiment of an attraction system that includes a ride vehicle and a display coupled to an actuator, in accordance with an aspect of the present disclosure.

FIG. 6 is a perspective view of an embodiment of the attraction system 50. In the illustrated embodiment, the display 60 is coupled to (e.g., directly coupled to) the actuator 70, and the actuator 70 is separate from the ride vehicle 54. That is, the ride vehicle 54 is not coupled to the actuator 70. For example, the ride vehicle 54 may be coupled to a separate actuator, and/or the ride vehicle 54 may be configured to move along a path (e.g., the path 56 of FIGS. 1 and 3). The ride vehicle 54 may be configured to move, and the control system 62 may be configured to operate the actuator 70 to move the display 60 as the ride vehicle 54 is in motion. In an embodiment, the control system 62 may be configured to determine a position and/or orientation of the ride vehicle 54 in the attraction system 50 (e.g., based on data received from the sensor 68), and the control system 62 may be configured to operate the actuator 70 to position the display 60 based on the position and/or orientation of the ride vehicle 54. For example, the control system 62 may be configured to operate the actuator 70 to position the display 60 in front of and/or adjacent to the ride vehicle 54 to enable the guests 52 positioned within the ride vehicle 54 to see the output of the display 60. In an additional or alternative embodiment, the control system 62 may be configured to operate the actuator 70 independently of movement of the ride vehicle 54. By way of example, the control system 62 may be configured to operate the actuator 70 to move the display 60 in a predetermined manner and/or based on a user input regardless of the position and/or orientation of the ride vehicle 54. In either embodiment, the control system 62 may be configured to operate the display 60 to provide an output based on a position and/or orientation of the display 60.

Figure 7:
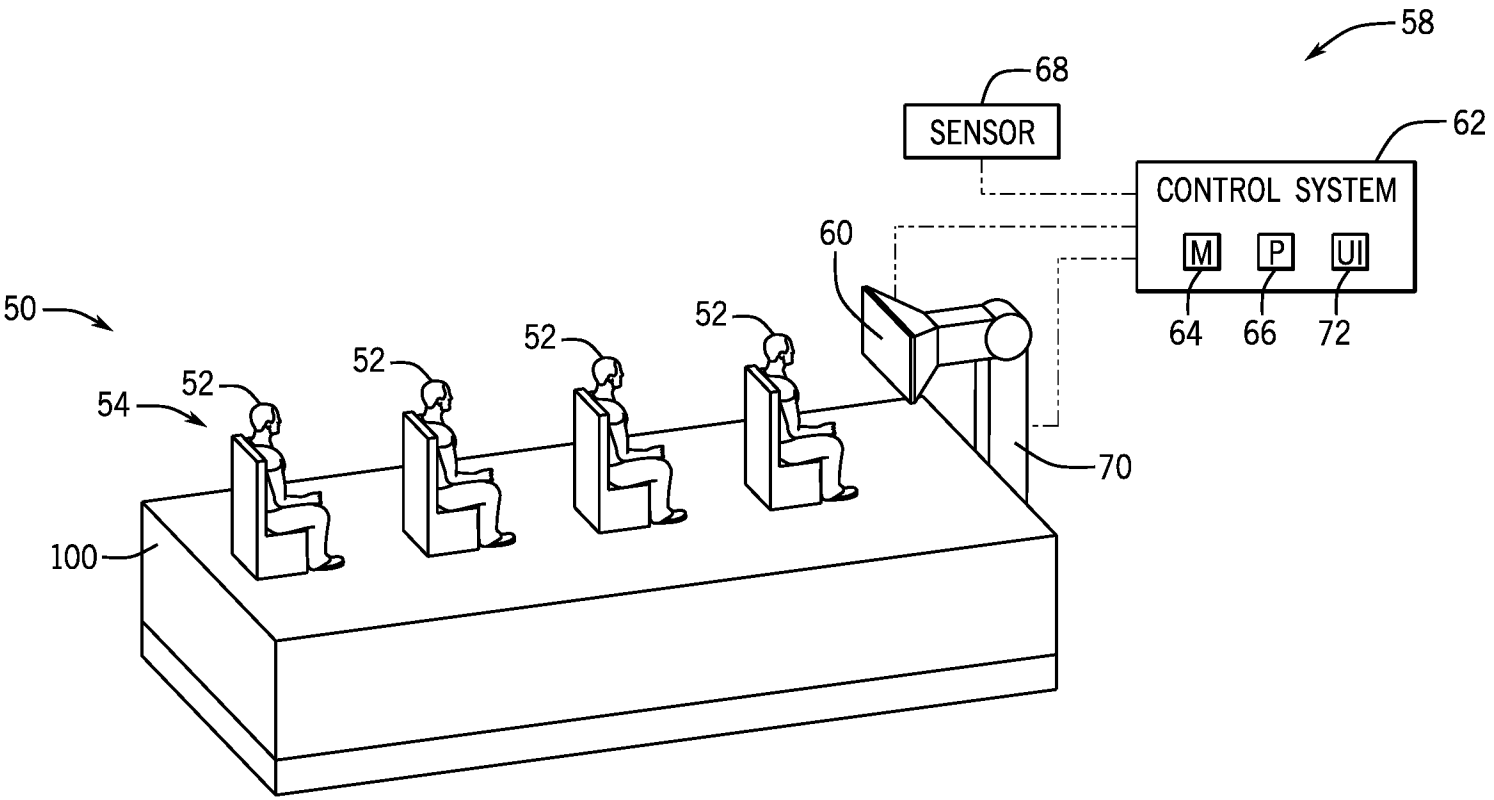
FIG. 7 is a perspective view of an embodiment of an attraction system that includes a ride vehicle, an actuator coupled to the ride vehicle, and a display coupled to the actuator, in accordance with an aspect of the present disclosure.

FIG. 7 is a perspective view of an embodiment of the attraction system 50. In the illustrated embodiment, the actuator 70 is coupled to (e.g., directly coupled to) the chassis 100 of the ride vehicle 54, and the display 60 is coupled to (e.g., directly coupled to) the actuator 70. During operation of the attraction system 50, the ride vehicle 54 may be configured to move, such as via an actuator separate from the actuator 70 and/or along a path. Movement of the ride vehicle 54 may drive movement of the actuator 70 and therefore movement of the display 60. Moreover, the control system 62 may be configured to operate the actuator 70 to move the display 60 relative to the chassis 100. Thus, movement of the display 60 may be caused by movement of the ride vehicle 54 (e.g., of the chassis 100) and/or by operation of the actuator 70. By way of example, the control system 62 may be configured to instruct the actuator 70 to move the display 60 in a predetermined path, based on a position and/or orientation of the guests 52 within the ride vehicle 54, based on a position and/or orientation of the ride vehicle 54 in the attraction system 50, based on a user input received from one of the guests 52, and the like. For instance, the control system 62 may cause the actuator 70 to move the display 60 that enables the guests 52 to view the output of the display 60 more easily based on the positioning of the ride vehicle 54.

The control system 62 may be configured to operate the display 60 to provide an output based on the position and/or orientation of the display 60 in the attraction system 50 as caused by the movement of the ride vehicle 54 and/or the operation of the actuator 70. As an example, the control system 62 may determine a position and/or orientation of the ride vehicle 54, a position and/or orientation of the actuator 70, and the position and/or orientation of the display 60 based on the determined positions and/or orientations of the ride vehicle 54 and the actuator 70. As another example, the control system 62 may determine the position and/or orientation of the actuator 70 without determining the position and/or orientation of the ride vehicle 54 and/or of the actuator 70. For instance, the sensor 68 may be configured to directly determine the position and/or orientation of the display 60, and the control system 62 may directly determine the position and/or orientation of the display 60 based on data received from the sensor 68 without having to determine the position and/or orientation of the ride vehicle 54 and/or the actuator 70. In any case, based on the determined position and/or orientation of the display 60, the control system 62 may cause the display 60 to provide an output, such as imagery of a virtual environment, that the guests 52 may view from within the chassis 100 as the ride vehicle 54 moves through the attraction system 50.

Figure 8:
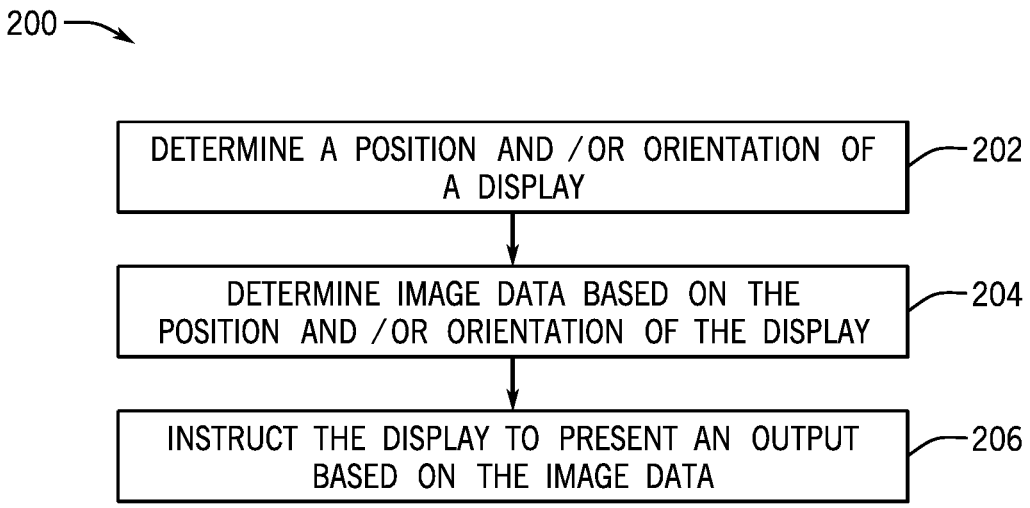
FIG. 8 is a flowchart of an embodiment of a method or process for operating an attraction system, in accordance with an aspect of the present disclosure.

FIG. 8 is a flowchart of an embodiment of a method or process 200 for operating an attraction system (e.g., the attraction system 50 of FIGS. 1-7). Any suitable device (e.g., the processing circuitry 66 of the control system 62 of FIGS. 1-7) may perform the method 200. In one embodiment, the method 200 may be implemented by executing instructions stored in a tangible, non-transitory, computer-readable medium (e.g., the memory 64 of the control system 62). For example, the method 200 may be performed at least in part by one or more software components, one or more hardware components, one or more software applications, and the like. While the method 200 is described using steps in a specific sequence, additional steps may be performed, the described steps may be performed in different sequences than the sequence illustrated, and/or certain described steps may be skipped or not performed altogether.

At block 202, a position and/or orientation of a display may be determined. In one embodiment, the position and/or orientation of the display may be determined based on data received from a sensor. For example, the data may include an image of the attraction system, movement of the display, a positioning of a ride vehicle to which the display is coupled, a positioning of an actuator to which the display is coupled, and so forth. Indeed, the position and/or orientation of the display may be determined or derived based on a determined position and/or orientation of an actuator and/or ride vehicle to which the display is coupled. For example, the actuator and/or ride vehicle may be instructed to move to a target position and/or target orientation (e.g., based on a user input), and the position and/or orientation of the display may be determined based on the target position and/or target orientation of the actuator and/or ride vehicle.

At block 204, image data may be determined based on the position and/or orientation of the display. For example, reference data that associates respective image data with corresponding positions and/or orientations of the display may be utilized, and the image data associated with the determined position and/or determined orientation of the display may be selected based on the reference data. In an embodiment, the image data may correspond to imagery of a virtual environment.

At block 206, the display may be instructed to present an output based on the image data. For example, the image data may be transmitted to the display to cause the display to present the output according to the image data. In an embodiment, the output may include an image, such as a single image. In an additional or alternative embodiment, the output may include a video or multiple images presented in a sequential order.

The steps of the method 200 may be repeated during operation of the attraction system. That is, the position and/or orientation of the display may be repeatedly or continually determined. In response, updated image data may be repeatedly determined, and the display may be repeatedly instructed to present an output based on the updated image data. As such, movement of the display may cause the display to present an updated output. By way of example, the output presented by the display may include imagery of a virtual environment seen from a particular viewpoint corresponding to the positioning of the display, and movement of the display may cause the display to present updated imagery of the virtual environment from an updated viewpoint corresponding to the movement of the display to an updated positioning. Thus, the updated output presented by the display may portray movement of the display in the virtual environment in accordance with movement of the display in the real world. In this manner, the appearance of the virtual environment may be more realistically portrayed.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An attraction system, comprising:

a ride vehicle configured to move within the attraction system;

a display directly coupled to the ride vehicle, wherein the display is configured to concurrently present imagery to a plurality of guests; and a control system communicatively coupled to the display, wherein the control system is configured to perform operations comprising:

determining a position of the display and an orientation of the display within the attraction system; and operating the display to present an image of the imagery based on the position of the display and the orientation of the display.

2. The attraction system of claim 1, wherein the control system is configured to perform operations comprising:

determining image data based on the position of the display and the orientation of the display; and transmitting the image data to the display to cause the display to present the image based on the image data.

3. The attraction system of claim 2, wherein the control system is configured to perform operations comprising:

referencing data associating a plurality of image data to respective corresponding positions of the display and respective corresponding orientations of the display, wherein the plurality of image data comprises the image data; and selecting the image data from plurality of image data based on the image data being associated with the position of the display and the orientation of the display.

4. The attraction system of claim 1, wherein the ride vehicle is configured to move along a path within the attraction system to drive movement of the display.

5. The attraction system of claim 1, comprising an actuator, wherein the control system is communicatively coupled to the actuator, and the control system is configured to instruct the actuator to cause movement of the ride vehicle within the attraction system.

6. The attraction system of claim 5, wherein the actuator comprises a robotic arm.

7. The attraction system of claim 1, wherein the ride vehicle is configured to move within a physical space of the attraction system, and wherein determining the position of the display and the orientation of the display within the attraction system comprises:

determining the position of the display and the orientation of the display within a three-dimensional (3-D) coordinate system of the physical space, wherein the 3-D coordinate system of the physical space is associated with a 3-D model of a virtual space; and determining image data from the 3-D model of the virtual space based on the position of the display and the orientation of the display within the 3-D coordinate system of the physical space and a correlation between the 3-D coordinate system of the physical space and the 3-D model of the virtual space, wherein the image is based on the image data.

8. A non-transitory computer-readable medium comprising instructions that, when executed by processing circuitry, cause the processing circuitry to perform operations comprising:

instructing an actuator of an attraction system to move a display coupled to the actuator within a physical space, wherein the display is configured to concurrently present imagery to a plurality of guests;

determining a positioning of the display and an orientation of the display within a three-dimensional (3-D) coordinate system of the physical space, wherein the 3-D coordinate system of the physical space is associated with a 3-D model of a virtual space;

determining image data from the 3-D model of the virtual space based on the positioning of the display and the orientation of the display within the 3-D coordinate system of the physical space and a correlation between the 3-D coordinate system of the physical space and the 3-D model of the virtual space; and instructing the display to present an image of the imagery based on the image data.

9. The non-transitory computer-readable medium of claim 8, wherein the actuator is coupled to a ride vehicle of the attraction system, the display is coupled to the actuator, and the instructions, when executed by the processing circuitry, cause the processing circuitry to instruct an additional actuator to move the ride vehicle, and movement of the ride vehicle via the additional actuator causes corresponding movement of the actuator and the display.

10. The non-transitory computer-readable medium of claim 9, wherein the instructions, when executed by the processing circuitry, cause the processing circuitry to perform operations comprising:

determining an updated positioning of the display and an updated orientation of the display in response to instructing the actuator to move the display or in response to instructing the additional actuator to move the ride vehicle;

determining additional image data based on the updated positioning of the display and the updated orientation of the display; and instructing the display to present an additional image based on the additional image data.

11. The non-transitory computer-readable medium of claim 8, wherein the instructions, when executed by the processing circuitry, cause the processing circuitry to perform operations comprising:

receiving data from a sensor; and determining the positioning of the display and the orientation of the display based on the data received from the sensor.

12. The non-transitory computer-readable medium of claim 8, wherein the instructions, when executed by the processing circuitry, cause the processing circuitry to perform operations comprising:

determining a positioning of a guest of the plurality of guests within the attraction system; and instructing the actuator to move the display based on the positioning of the guest.

13. The non-transitory computer-readable medium of claim 8, wherein the instructions, when executed by the processing circuitry, cause the processing circuitry to perform operations comprising:

determining a positioning of a ride vehicle within the attraction system; and instructing the actuator to move the display based on the positioning of the ride vehicle.

14. An attraction system, comprising:

a display directly coupled to an actuator, wherein the display is configured to concurrently present imagery to a plurality of guests;

a ride vehicle directly coupled to the actuator, wherein the ride vehicle is configured to move and cause movement of the actuator and the display; and a control system communicatively coupled to the display, wherein the control system is configured to perform operations comprising:

instructing the actuator to move the display;

determining a position of the display and an orientation of the display within the attraction system; and operating the display to present an image of the imagery based on the position of the display and the orientation of the display within the attraction system.

15. The attraction system of claim 14, wherein the control system is configured to instruct the actuator to move the display relative to the ride vehicle.

16. The attraction system of claim 14, wherein the control system is configured to present the image based on a correlation between the position of the display and the orientation of the display and an aspect of a virtual space defined by a three-dimensional (3-D) model.

17. The attraction system of claim 14, wherein the control system is configured to perform operations comprising:

receiving a user input; and instructing the actuator to move the display based on the user input.

18. The attraction system of claim 14, comprising a sensor, wherein the control system is communicatively coupled to the sensor, and the control system is configured to perform operations comprising:

receiving data from the sensor; and determining the position of the display and the orientation of the display based on the data received from the sensor.

19. The attraction system of claim 18, wherein the sensor comprises a position sensor, a movement sensor, or both.

20. The non-transitory, computer-readable medium of claim 8, wherein the positioning of the display and/or the orientation of the display is customizable for different ride cycles based on a user input.

* * * * *